US009523186B1

(12) United States Patent
Brannan

(10) Patent No.: US 9,523,186 B1
(45) Date of Patent: Dec. 20, 2016

(54) DEVICE AND METHOD FOR ADVERTISEMENTS UPON A RING

(71) Applicant: Ann B. Brannan, Webster Groves, MO (US)

(72) Inventor: Ann B. Brannan, Webster Groves, MO (US)

( * ) Notice: Subject to any disclaimer, the term of this patent is extended or adjusted under 35 U.S.C. 154(b) by 283 days.

(21) Appl. No.: 14/212,101

(22) Filed: Mar. 14, 2014

Related U.S. Application Data

(60) Provisional application No. 61/790,888, filed on Mar. 15, 2013.

(51) Int. Cl.
*A47K 1/14* (2006.01)
*E03C 1/264* (2006.01)

(52) U.S. Cl.
CPC *E03C 1/264* (2013.01); *A47K 1/14* (2013.01)

(58) Field of Classification Search
CPC ..... A47K 1/14
USPC ..... 4/286–295
See application file for complete search history.

(56) References Cited

U.S. PATENT DOCUMENTS 2,575,586 A * 11/1951 Crall ..... E03C 1/264 210/238
5,209,257 A * 5/1993 Baker, Jr. ..... E03F 5/08 137/192
7,467,425 B2 * 12/2008 Harmes ..... A47K 1/14 4/286

* cited by examiner

*Primary Examiner* — Lori Baker
(74) *Attorney, Agent, or Firm* — Charles McCloskey

(57) ABSTRACT

A device and method for advertisements upon a ring has a gage of a short cylindrical shape with a centered tip. The gage aligns a planar material, or ring, placed outwardly upon it. The tip fits into any hole of a drain in a sink. The tip then aligns the gage, centering it upon the drain which leads to a centered application of the planar material upon the drain or nearby sink bowl. The gage has two surfaces, a top and an opposite bottom that has the tip joined thereto. Between the two surfaces and upon its perimeter, the gage has a wall with a slight outward flare with its wide portion towards the bottom. The flare centers the ring as a user places it upon the gage and moves it down to the drain. The user then removes the gage through the ring.

11 Claims, 7 Drawing Sheets

DEVICE AND METHOD FOR ADVERTISEMENTS UPON A RING

CROSS-REFERENCE TO RELATED APPLICATION

This non-provisional application claims priority to the provisional application 61/790,888 filed on Mar. 15, 2014 which is owned by the same inventor.

BACKGROUND OF THE INVENTION

The device and method for advertisements upon a ring generally relates to bathroom accessories and more specifically to a tool for placing a thin annulus near a sink's drain. More particularly, the invention attaches an annular material with indicia thereon outwardly of the holes near a drain's collar or outwardly of a sink's drain.

People use sinks in many places at work, at home, when travelling, and elsewhere. Sinks allow for delivery of water in a convenient location without the water running over the location, excepting a drain blockage. Sinks can be in a bathroom, a kitchen, a laundry room, a wet bar, an entertainment room, an entertainment area, and the like. In those locations, people may use water to perform various functions as commonly known.

In various establishments such as bars and hotels, and in public restrooms as at airports, advertising has appeared above or adjacent to stalls, particularly above urinals. At that location, men see the advertisements and a percentage of the men act on the advertisement. Building codes and astute management generally provide sinks in such establishments. Public areas, such as hotels, sporting venues of all kinds, convention centers, airport terminals, restaurants, and the like, also have plenty of sinks in each facility. These preceding sinks each have a drain that users often seen when washing their hands or otherwise using the sink. The flat surfaces near each drain provide the opportunity for placing advertising that many would see.

People enjoy many kinds of advertisements. Advertisers also produce advertising in many creative ways. People also tire of advertisements after a time which spurs advertising companies to create new ads. Advertisements placed near sink drains also require changing from time to time. Advertisements near drains would break up the functional and boring appearance of a drain, perhaps to the delight of the user. Even with those advertisements, the humble sink drain retains its functional use discharging water from the sink into the wastewater system, unimpeded.

Over the years, sinks and their drains, particularly in public areas, have developed into a pleasing though rugged appearance. The sinks generally have a nearly flat bottom with the drain towards the center of the bottom. The drain often has a planar form with nineteen holes through it in a three, four, five, four, three pattern arranged in a compact hexagon. The nineteen hole pattern occupies the center of the drain with a solid border outside of the holes to the edge of the drain. The nineteen hole pattern appears often in bathrooms however other hole patterns may exist. Because drains encounter water and other substances placed into them, along with various forms of abuse, placement of advertisements on drains has lagged far behind the rest of the decorations in a bathroom or other setting.

DESCRIPTION OF THE PRIOR ART

Over the years, venue operators, restaurateurs, hoteliers, sports franchises, transport authorities, governments, and the like have sought to improve the look and appearance of their bathrooms, sinks, and drains, and in some instances to raise a little revenue from them. Over the years, bathrooms and restrooms have had makeovers to brighten them and to install motion activated faucets and other dispensers. Select bathrooms have installed advertising panels, and in some cases computer screens, on the walls where seen by users of the bathrooms.

A well mannered user, after seeing the advertising panels, then moves to a sink and washes up. More and more sinks, especially in public restrooms, have motion activated faucets that make using the sinks easier and more convenient. Easier to use sinks attract more people. As more people wash up, they will casually glance at the drain during washing. In that glance, a person sees a typical drain, usually chrome, bland, and functional. Most people do not give a second thought to a drain. However, as people use sinks they do see the drain. Perhaps people's glances at a drain can be put to use.

SUMMARY OF THE INVENTION

The device and method for advertisements upon a ring has a gage, generally a short round cylinder, with a centered tip. The gage aligns a planar material placed outwardly upon it. The tip fits into any hole of a multiple hole drain in a sink, such as at a public restroom. Preferably, a user aligns the tip for placement into the center of a pattern of holes for a centered installation of the device, if desired. The tip then aligns the gage to be centered upon the drain which leads to a centered application of the planar material upon the sink bowl near a drain. The gage has two surfaces, a top and an opposite bottom that has the tip joined thereto. Between the two surfaces and upon its perimeter, the gage has a wall with a slight inward flare, or bevel, with its wide portion towards the bottom. The flare centers the planar material as a user places it upon the gage and moves it downwardly towards the drain. The user then removes the gage through the planar material, leaving it behind, centered upon the drain. The planar material is preferably a ring having indicia upon it.

There has thus been outlined, rather broadly, the more important features of the invention in order that the detailed description thereof that follows may be better understood and that the present contribution to the art may be better appreciated. The present invention also includes gage diameters of 1.25 inch, 1.5 inch, 2 inch, or up to 3 inch, a constant diameter, a tip slightly less in length than the gage is of height, an additional 1 inch to 2 inch width to cover the drain ring, fiberglass strands embedding in the decorative layer for rigidity, and a thickness of the device less than that of a cap upon a stopper. A further alternate embodiment of the invention includes an annular ring that fits upon the drain ring only of a sink, preferably a flat commercial drain. Though the preferred and alternate embodiments above refer to the size of the cap, the invention may have an inexact fit to certain stoppers or drains. The Applicant prefers that the invention has a slightly less diameter or width in an inexact fit so the remaining visible cap or drain provides a frame or border to the inexactly fit disc. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a device and method for advertisements upon a ring that places an advertisement readily near a drain.

Another object is to provide such a device and method for advertisements upon a ring that centers the advertisements upon a drain.

Another object is to provide such a device and method for advertisements upon a ring that fits upon a drain with multiple holes without impeding water flow.

Another object is to provide such a device and method for advertisements upon a ring that installs with a minimum of skilled labor.

Another object is to provide such a device and method for advertisements upon a ring that removes the advertisement without damaging the drain or adjacent sink.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
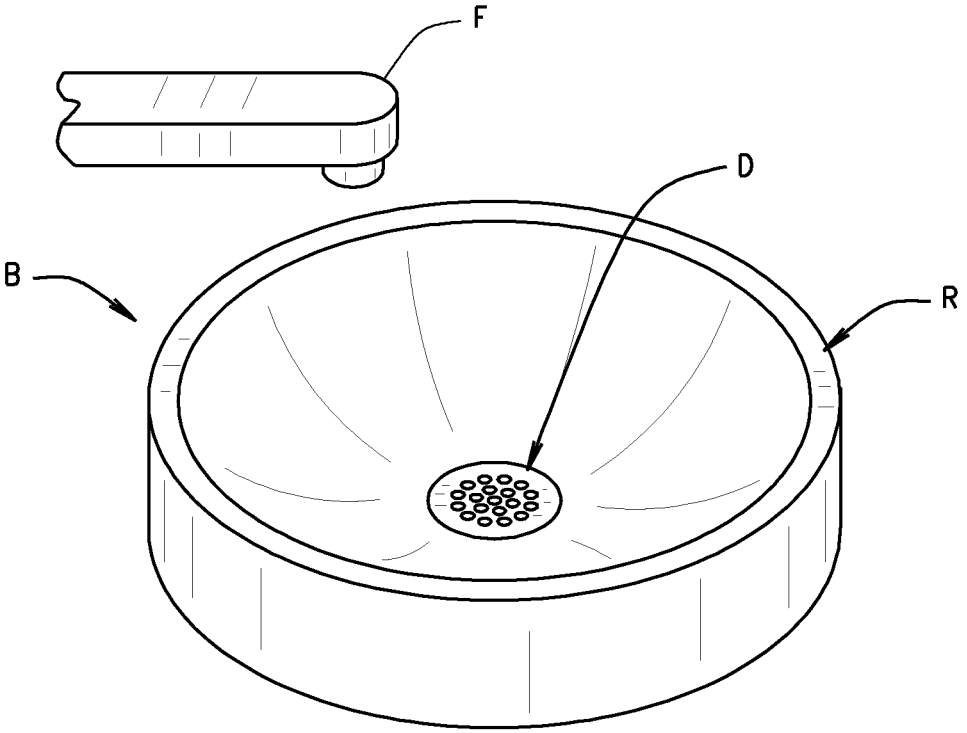
FIG. 1 provides a perspective view of a sink with a drain.

The present art overcomes the prior art limitations by providing a decorative attachment device for improving, modifying, or altering the appearance of a sink or a basin, typically in a bathroom, restroom, and the like. A sink can take many forms but an oval or a round shape appears often as shown in FIG. 1. The sink B has its rim R that generally abuts upon a top not shown. A faucet F extends into the sink as commonly seen. Inwardly from the rim, the sink drops downwardly below the plane of the top. The sink drops left to right and front to back forming a depression, or bowl like shape so that any fluids, powders, dusts, and solids placed into the sink move under gravity towards the bottom of the sink. The bottom of the sink has the lowest distance beneath the rim R and the adjacent top as is commonly seen. At the bottom, the sink has a drain D, typically with a plurality of holes. The drain appears as the uppermost portion of tubular hardware secured to the sink bowl that leads into the wastewater system, not shown. In some sinks, the bowl is nearly flat in the vicinity of the drain. Though FIG. 1 shows a classic sink, the Applicant foresees application of the invention upon sinks of various shapes and curvatures and with drains of various sizes and hole patterns. Preferably, a user of the invention has turned off water to the sink, or otherwise inactivated any motion sensors, and checked that the sink near the drain is dry prior to installation of the invention. The description that follows in referring to the invention upon a sink drain also applies to the invention seeing use with floor and shower drains as well.

Figure 2:
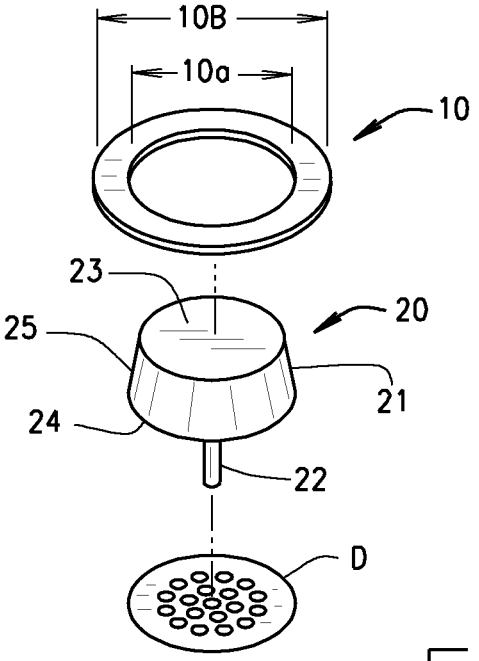
FIG. 2 shows an exploded view of components of an alternate embodiment the invention.

Turning to FIG. 2, the invention appears in an exploded view above a drain D. The invention includes an advertisement 10 here shown as a ring though the Applicant foresees other shapes for the advertisement, such as scalloped, serrated, zigzag, and the like. The other shapes will have a round aperture for usage with the invention. This description proceeds with a ring, or annular shape, representing the other possible shapes for the advertisement component of the invention. The advertisement 10 has an inner diameter 10*a*, and an outer diameter 10*b* that exceeds the inner diameter. The inner diameter is at least that of the outermost diameter of the hole pattern in a drain. The advertisement does not impede the draining of fluids and slurries through the drain. The outer diameter is at least that of the diameter of the drain itself, usually seen as a metal plate having the hole pattern. Beneath the ad 10 in this figure, the invention has the gage 20 with its body 21, generally rounded, and its tip 22, centered and perpendicular to the body. The body has a top surface 23 and an opposite bottom surface 24 joined by a circumferential wall 25. Preferably, the round gage has a round top surface and a round bottom surface. In an alternate embodiment, the top surface has a slightly less diameter than the bottom surface resulting in the wall having a slight inward cant and the body having a truncated conical shape. The cant of the wall provides for mechanical centering of an ad 10 placed upon the gage during installation. The bottom surface has a diameter slightly less than the inner diameter of the ad 10. The diameter of the bottom surface also exceeds the diameter of a typical multiple hole pattern in a drain D. In an alternate embodiment, the diameter of the bottom surface exceeds the diameter of the drain D. In an alternate embodiment, the diameter of the top surface is the same as the diameter of the bottom surface making the circumferential wall perpendicular to both the top surface and the bottom surface, or a right cylinder. In a further alternate embodiment, the ad 10 and the top surface 23, bottom surface 24, or circumferential wall 25 each include a marking. The marking upon the ad and the marking upon either the top surface, bottom surface, or circumferential wall would guide a user to align the ad to the gage for a proper application of the ad upon the drain. The user would previously have oriented the marking upon the top surface, bottom surface, or circumferential wall towards the faucet of the sink or other preselected position. The marking may include a symbol, letter, triangle, boss, and the like that a user may see during before and during installation.

Figure 3:
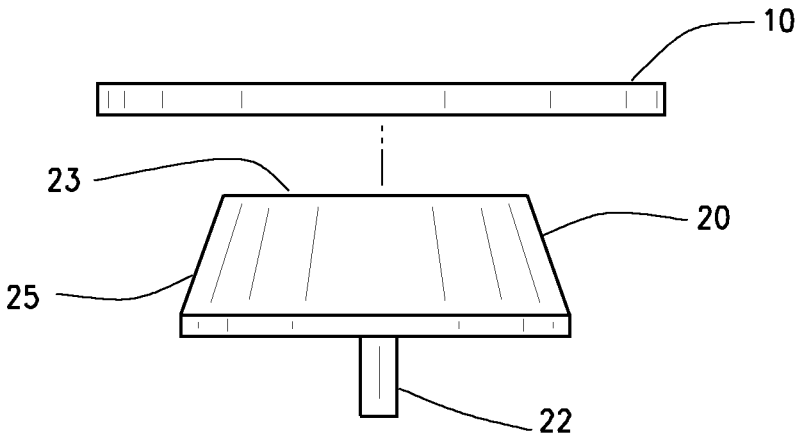
FIG. 3 shows a side view of an alternate embodiment of the invention.

Looking more closely, FIG. 3 provides a side view with the gage 20 placed upon the drain D. The gage has its bottom surface adjacent to the drain and the tip 22 generally inserted into the center of the drain D as shown. The wall 25 extends upwardly from the bottom surface and in this embodiment, the wall bevels inwardly as it climbs away from the bottom surface. Opposite the drain, the gage 20 has its top surface 23 visible to a user. The top surface, in this embodiment, has a slightly less diameter than the bottom surface. The top surface is now ready to receive the ad 10 in its annular shape. The inner diameter 10*a* of the ad 10 fits upon the top surface and then self centers as the ad passes down the wall 25.

Figure 4:
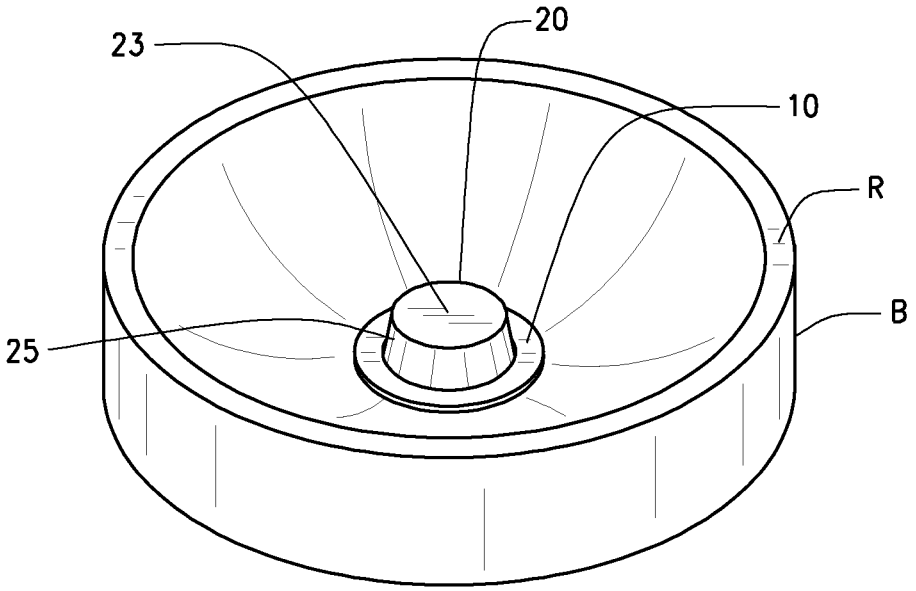
FIG. 4 shows a perspective view of an alternate embodiment of the invention upon a drain in a sink.

When the ad 10 passes down the entire wall 25, FIG. 4 shows the ad 10 placed upon the drain D within the bowl B of a sink. The ad rests upon the drain and if wide enough, the ad extends upon the bowl of the sink outwardly from the drain. The gage 20 still extends upwardly from the drain and with its wall and top surface shown through the ad 10.

Figure 5:
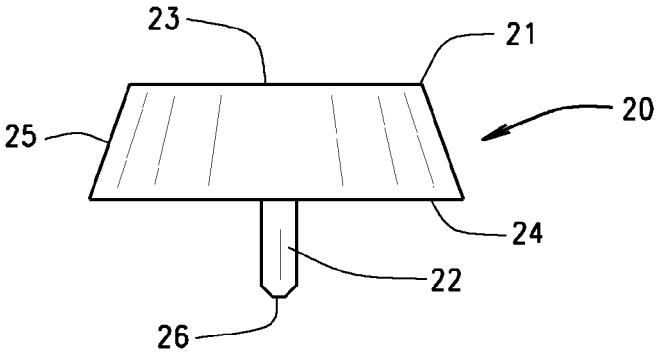
FIG. 5 illustrates a side view of a component of an alternate embodiment of the invention.

FIG. 5 shows a side view of the gage 20 alone. The gage has its generally rounded body 21 with the centered and perpendicular tip 22. The tip is preferably round in its cross section to fit into a drain hole however, the Applicant foresees other cross section shapes for specific drain hole geometries. The tip has a cylindrical shape in the alternate embodiment. The tip extends away from the bottom surface 24 and generally has a constant width. Outwardly from the bottom surface, the tip has its nose 26 upon an end so that the nose inserts first into a drain hole during usage of the invention. As above, the top surface 23 is opposite the bottom surface and the circumferential wall 25 joins to both surfaces. Preferably, the gage is round with round top and bottom surfaces. Here, the top surface has a slightly less diameter than the bottom surface so the wall attains a beveled, or inwardly canted, edge as part of a truncated conical shape. The bevel, or cant, of the wall provides for mechanical centering of the ad 10 placed upon the gage during installation as shown in FIGS. 2-4. The bottom surface has its diameter slightly less than the inner diameter of the ad 10. In an alternate embodiment, the top surface has joining to it a removal device. The removal device allows a user to grip it and then remove the entire gage 20 from a drain without having to grip the circumferential wall 25 or the circumference of the bottom surface. The removal device is generally elongated and extends perpendicular to the top surface, generally opposite the tip 22. The removal device may have the form of a slender cylinder or rod, a hook, a loop, a knob, and the like.

Figure 6:
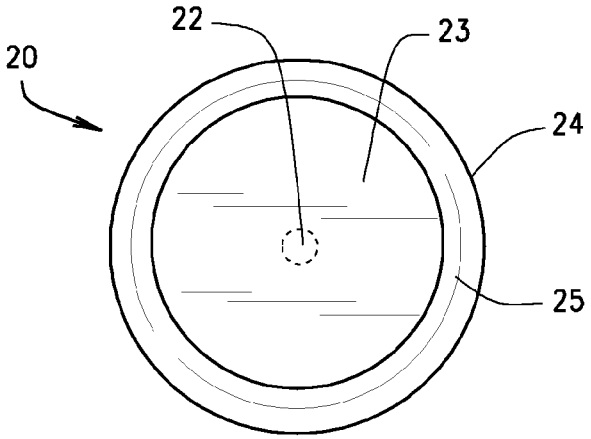
FIG. 6 provides a top view of the component of the alternate embodiment.

FIG. 6 shows a top view of the gage 20 with the body in the foreground and the tip 22 in the background and shown in phantom. In this view, the gage has its top surface 23 preferably round but of a slightly lesser diameter than the bottom surface 24. From the top surface to the bottom surface, the wall 25 extends outwardly, joining the two surfaces. The wall begins with its diameter being that of the top surface then it expands to that of the bottom surface. The gage has its tip generally centered upon the bottom surface of the body.

Figure 7:
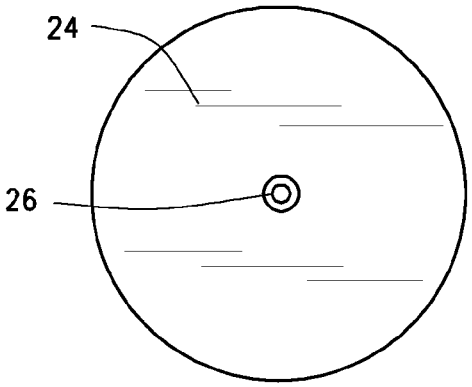
FIG. 7 provides a bottom view of the component of the alternate embodiment.

The tip 22 appears nose 26 first, that is, in the foreground of FIG. 7. FIG. 7 shows a bottom view of the gage but with the tip in the foreground and the body in the background. The tip has a width, here shown as a diameter, markedly less than the diameter of the bottom surface 24. The bottom surface has its generally round shape as previously described. In an alternate embodiment, the nose has a slightly lesser width than that of the remainder of the tip to ease its insertion into a hole of a drain D.

Figure 8:
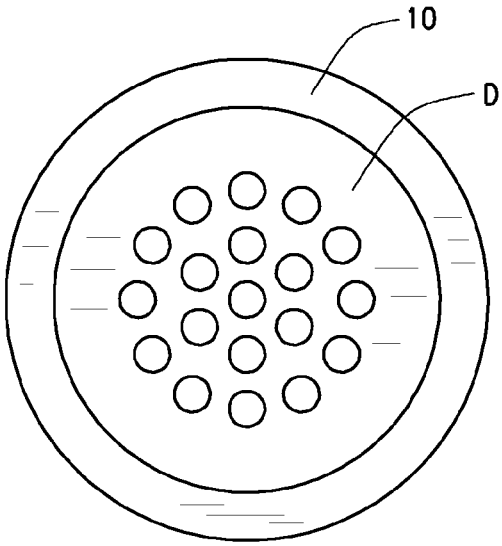
FIG. 8 shows a top view of a drain following application the alternate embodiment of the invention.

Upon removing the gage 20, the drain D has the ad 10 as shown in FIG. 8. The ad is generally centered upon the drain and outwardly from the holes so that drainage continues without interruption.

In a further alternate embodiment, the invention utilizes a gage 20 having a tip 22 alone. The tip has the form of a hollow cylinder but with an enlargement along its length. The enlargement can be a deformation of the cylinder outwardly as from compression, a ring press fit upon the tip, or a bead molded into the tip. The enlargement is approximately midpoint along the length of the tip. During usage of the invention, a user places this alternate gage near a drain D and inserts the tip into a hole of the drain pattern. The tip then advances into the hole until the enlargement comes to rest upon the drain. In this position, a portion of the tip remains above the drain, ready to receive a cooperating opening in an ad 10. For this embodiment, the ad may have a solid, planar, circular form or alternatively a rectangular form. The ad may include its own pattern of holes to cooperate with the drain.

In a further alternate embodiment, the gage has its tip but the tip has a generally hemispherical shape, similar to a button or a knob protruding from the bottom surface. The tip in this alternate embodiment has a diameter less than the distance or height between the top surface and the bottom surface. The tip here extends from the bottom surface but the gage has a generally short cylindrical shape, similar to a puck.

Figure 9A:
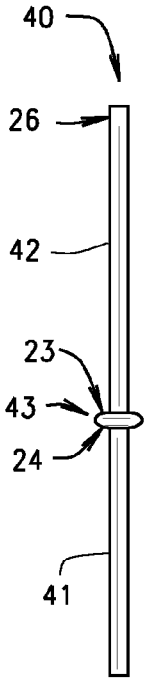
FIG. 9 shows alternate embodiments of the gage of the invention as in FIGS. 9*a*, 9*b*, 9*c;*

FIG. 9 shows three further alternate embodiments related to the tip 22. These embodiments, as at 40, 50, 60, deploy an advertisement 10 that has a plurality of holes in a planar material, but not a ring like shape as previously described. These alternate embodiments are generally slender and elongated with a maximum diameter that of one hole in the planar advertising material. From the left of the figure, alternate embodiment 40, shown at FIG. 9*a*, has a generally rod like form with an elongated tip 42 having a nose 26 towards the top of this figure and a shank 41 coaxial with the tip. Between the tip and the shank, this embodiment 40 has a centered disc 43 with a top surface 23 and a bottom surface 24 slightly spaced below the top surface. The centered disc 43 has its diameter slightly larger than a hole in a multiple hole drain and slightly less than a hole in the planar advertising material. The top surface 23 and the bottom surface 24 have the same diameter in this embodiment 40. The disc is generally centered along the combined length of the tip 42 and the shank 41. The shank may be incorporated into a handle or other means of assisting a user to grip the device during its usage. The tip and the shank have a diameter of about 1 mm to about 5 mm. In a further alternate embodiment, the rod like form with its tip 42 coaxial with the shank 41 has a bead substituted for the disc 43. The bead has a diameter of about 2 mm to about 7 mm.

Figure 9B:
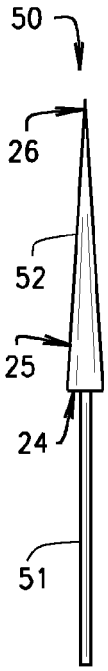

The second alternate embodiment 50, shown at FIG. 9*b*, has a generally arrow like form with an elongated conical tip 52 having a pointed nose 26 towards the top of this figure and a shank 51 coaxial with the tip but opposite from the tip. The tip has its narrower portion, that is, the smallest diameter of a component of this embodiment. Opposite the pointed tip 26, this embodiment 50 has its wider portion of the tip, shown as the bottom surface 24. The bottom surface has a diameter visibly wider than that of the pointed tip of this embodiment. The cone shaped tip has its bottom surface 24 of a diameter slightly larger than a hole in a multiple hole drain and slightly less than a hole in the planar advertising material. The shank may be incorporated into a handle or other means of assisting a user to grip the device during its usage.

Figure 9C:
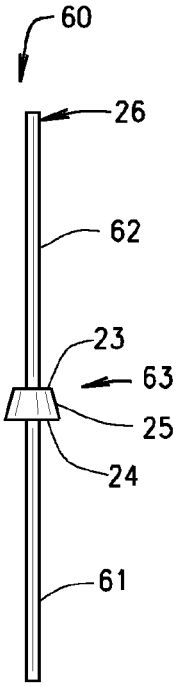

And the third alternate embodiment 60, shown at FIG. 9*c*, has a generally rod like form with a truncated conical portion 63 near the center of the embodiment 60. The truncated conical portion 63 has a top surface 23, an opposite bottom surface 24, and circumferential wall 25 similar to that previously described in relation to FIGS. 1-8. The truncated conical portion has its bottom surface slightly larger in diameter than a hole in a multiple hole drain and its top surface slightly less in diameter than a hole in the planar advertising material. The truncated conical portion has its own length much less than the length of the remaining rod. The truncated conical portion has its position between a tip 62 and a shank 61 as shown, generally midway along the embodiment. The shank may be incorporated into a handle or other means of assisting a user to grip the device during its usage.

In use, a device would incorporate any of these three alternate embodiments into a handle for usage upon a drain with the tip 42, 52, 62 inserting into one drain hole and then the widest portion of the disc 43, cone 53, or truncated cone 63 abutting the drain. A user then places the advertisement 10 upon the tip 42, 62 or narrow tip 52 of the cone and the rod or narrow tip enters one hole of the advertisement as the user slips the advertisement downwardly towards the drain. With the advertisement in place, the user lifts the shank 41, 51, 61 upwardly from the drain.

Figure 10:
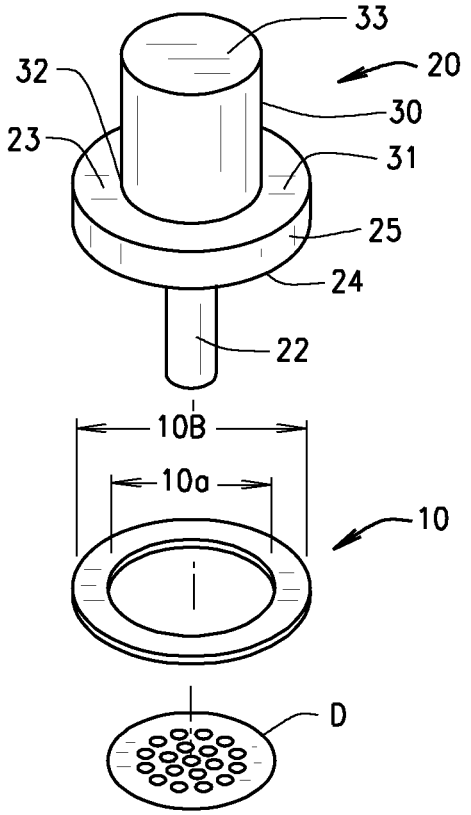
FIG. 10 illustrates an exploded view of components of the preferred embodiment the invention.

Turning to FIG. 10, the preferred embodiment of the invention appears in an exploded view above the drain D. As before the invention includes an advertisement 10 here shown as a ring beneath the gage 20 though the Applicant foresees other shapes for the advertisement, such as scalloped, serrated, zigzag, and the like. The other shapes will have a round aperture for usage with the invention. This description proceeds with a ring, or annular shape, representing the other possible shapes for the advertisement component of the invention. The advertisement 10 has its inner diameter 10*a*, and an outer diameter 10*b* greater than the inner diameter. The inner diameter is at least that of the outermost diameter of the hole pattern in a drain. The advertisement does not impede the operation of the drain. The outer diameter is at least that of the diameter of the drain itself, usually seen as a metal plate having the hole pattern. Beneath the ad 10 in this figure, the invention has the gage 20 with its handle 30 merged with a base 31 at a juncture 32, generally rounded, and its tip 22, centered and perpendicular to the base and opposite the handle. The handle has a generally cylindrical form and a top 33 generally oriented towards a user during usage of the invention. The base 31 has its top surface 23 and the opposite bottom surface 24 joined by a circumferential wall 25 as before. The top surface and the bottom surface are mutually parallel. However, the top surface and the bottom surface have the same diameter and a slight spacing apart, or a thickness, thus forming the base into a disc like shape as shown. The spacing between the top surface and the bottom surface provides the circumferential wall 25 that fits within the inner diameter 10*a* of the advertisement 10. Alternatively, the base rests upon a planar advertisement while the tip 22 fits into a hole through the advertisement. The tip has its slender and elongated form as shown. The diameter of the bottom surface also exceeds the diameter of a typical multiple hole pattern in a drain D. In an alternate embodiment, the diameter of the bottom surface exceeds the diameter of the drain D. For a further alternate embodiment, the ad 10 and the top surface 23, bottom surface 24, or circumferential wall 25 each include a marking. The marking upon the ad and the marking upon either the top surface, the bottom surface, or the circumferential wall would guide a user to align the ad to the gage for a proper application of the ad upon the drain. The user would previously have oriented the marking upon the top surface, bottom surface, or circumferential wall towards the faucet of the sink or other preselected position. The marking may include a symbol, letter, triangle, boss, and the like that a user may see during before and during installation.

Figure 11:
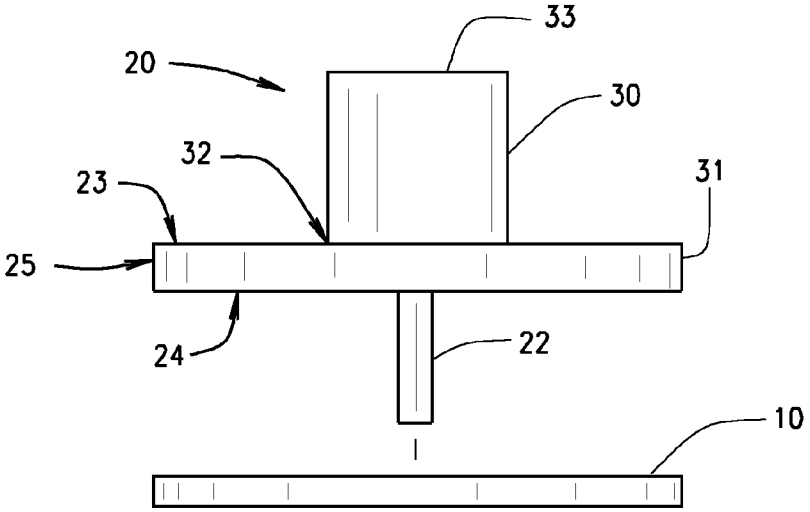
FIG. 11 provides a side view of the preferred embodiment of the invention engaged upon a drain.

Moving from FIG. 10, FIG. 11 provides a side view with the gage 20 ready for placement upon the ad 10 and then upon the drain D previously shown. The gage has its top 33 oriented away from the drain and the ad 10, its base 31 towards the ad, and its tip 22 generally centered upon the ad and positioned to subsequently insert through the ad and into the drain D and the centerline shown. The base has its diameter generally exceeding that of the handle 30 and fitting within the inner diameter of the ad as previously shown. The wall 25 extends upwardly from the bottom surface and in this embodiment, the wall has a generally square orientation to the bottom surface 23 and the top surface 24, that is, the wall has no bevel in contrast to the previous embodiments. The top surface 23 remains visible to a user during usage. As before, the top surface is now ready to receive the ad 10 in its annular shape. The inner diameter 10*a* of the ad 10 fits upon the top surface and then self centers as the ad passes down the wall 25.

Figure 12:
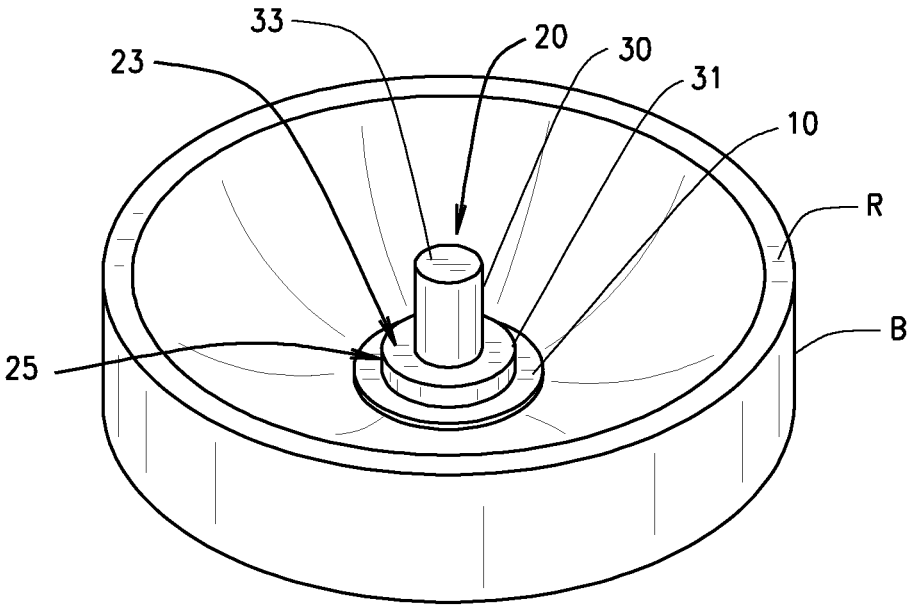
FIG. 12 shows a perspective view of the preferred embodiment of the invention upon a drain in a sink.

When the ad 10 adjoins the entire wall 25 or the base 31 rests upon the ad 10, FIG. 12 illustrates the ad 10 placed upon the drain D within the bowl B of a sink. The ad rests upon the drain and if wide enough, the ad extends upon the collar outwardly of the drain and even to the bowl of the sink outwardly from that. The gage 20 still extends upwardly from the drain. The handle 30 extends upwardly from the drain and the top surface 23 of the base 31 can be seen during usage.

Figure 13:
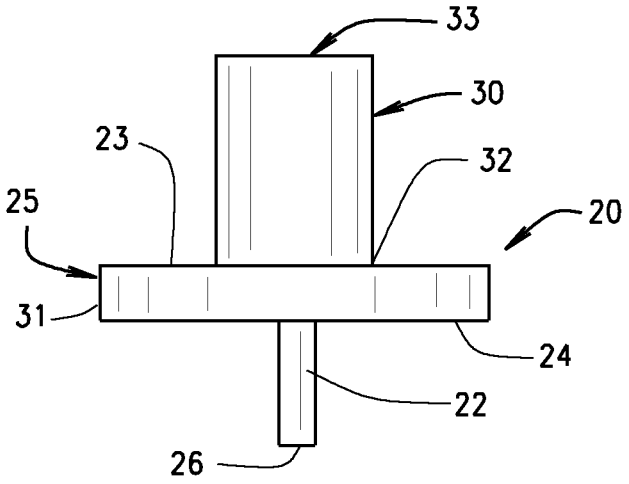
FIG. 13 provides a side view of a component of the preferred embodiment of the invention.

Removing the ad for a moment, FIG. 13 shows a side view of the gage 20 by itself. The gage has its generally cylindrical handle 30 upon the disc like base 31 with the centered and perpendicular tip 22 below it and extending opposite the handle. The handle has a diameter generally greater than that of the tip. The handle diameter provides for comfortable grasping by a user. The handle merges to the base at the juncture 32 that extends around the circumference of where the handle adjoins the disc. The tip is preferably round in its cross section to fit into a drain hole however, the Applicant foresees other cross section shapes to correspond with specific drain hole shapes. The tip its cylindrical shape in the preferred embodiment and extends away from the bottom surface 24 at a constant diameter, that is, width. Outwardly from the bottom surface, the tip has its nose 26 upon an end so that the nose inserts first into a drain hole during usage of the invention. The nose is generally square to the remainder of the tip, that is, flat. Akin to the tip in FIG. 5, the tip in FIG. 13 has a diameter of about 2.5 mm to about 6 mm and a length of about 12 mm to about 25 mm, and the base of FIG. 13 akin to the bottom surface of FIG. 5 has a diameter of about 20 mm to about 45 mm. As above, the top surface 23 is opposite the bottom surface and the circumferential wall 25 joins to both surfaces. Preferably, the handle is round with round top and bottom surfaces. Here, the top surface has that same diameter as the bottom surface so the wall 25 is generally parallel to the length of the handle. The removal device allows a user to grip the handle 30 and then remove the entire gage 20 from a drain without having to grip the circumferential wall 25 or the circumference of the bottom surface.

Figure 14:
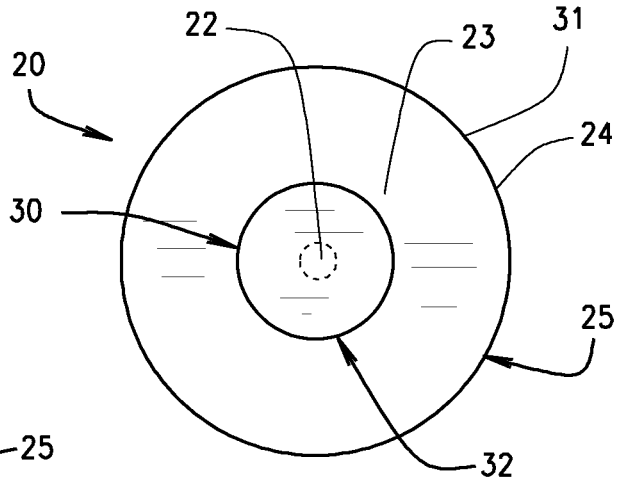
FIG. 14 shows a top view of the component of the preferred embodiment.

Looking at the top 33, FIG. 14 shows a top view of the preferred embodiment of the gage 20 with the handle 30 in the foreground and the tip 22 in the background and shown in phantom. In this view, the gage has its top 33 generally round as the upper end of the handle 30. Opposite the top, the handle merges with the base 31 at the juncture 32. Outwardly from the juncture, the base has its top surface 23 preferably round and of the same diameter as the bottom surface 24. From the top surface to the bottom surface, the wall 25 extends outwardly, joining the two surfaces. The wall has its height similar to the spacing between the top and bottom surfaces as previously shown. The gage has its tip 22 generally centered upon the bottom surface of the base.

Figure 15:
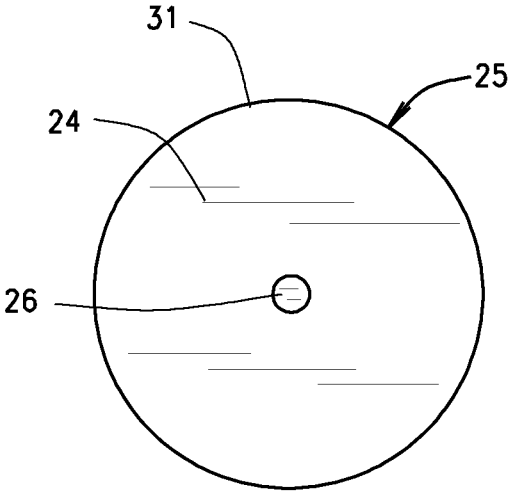
FIG. 15 illustrates a bottom view of the component of the preferred embodiment; and, FIG. 16 shows a flow chart of a method of this invention.

In the foreground of FIG. 15, the tip 22 appears nose 26 first. FIG. 15 provides a bottom view of the base 31 but with the tip in the foreground and the bottom surface 24 of the base 31 in the background. The tip has its flat nose and then a constant width, that is, diameter, markedly less than the diameter of the bottom surface 24. The tip extends from its nose to the bottom surface of the base. The tip merges with the base by mechanical means, press fit, adhesive, cohesive, thermal welding, and the like. The bottom surface is generally round and has a diameter slightly less than the inner diameter of an advertisement.

Figure 16:
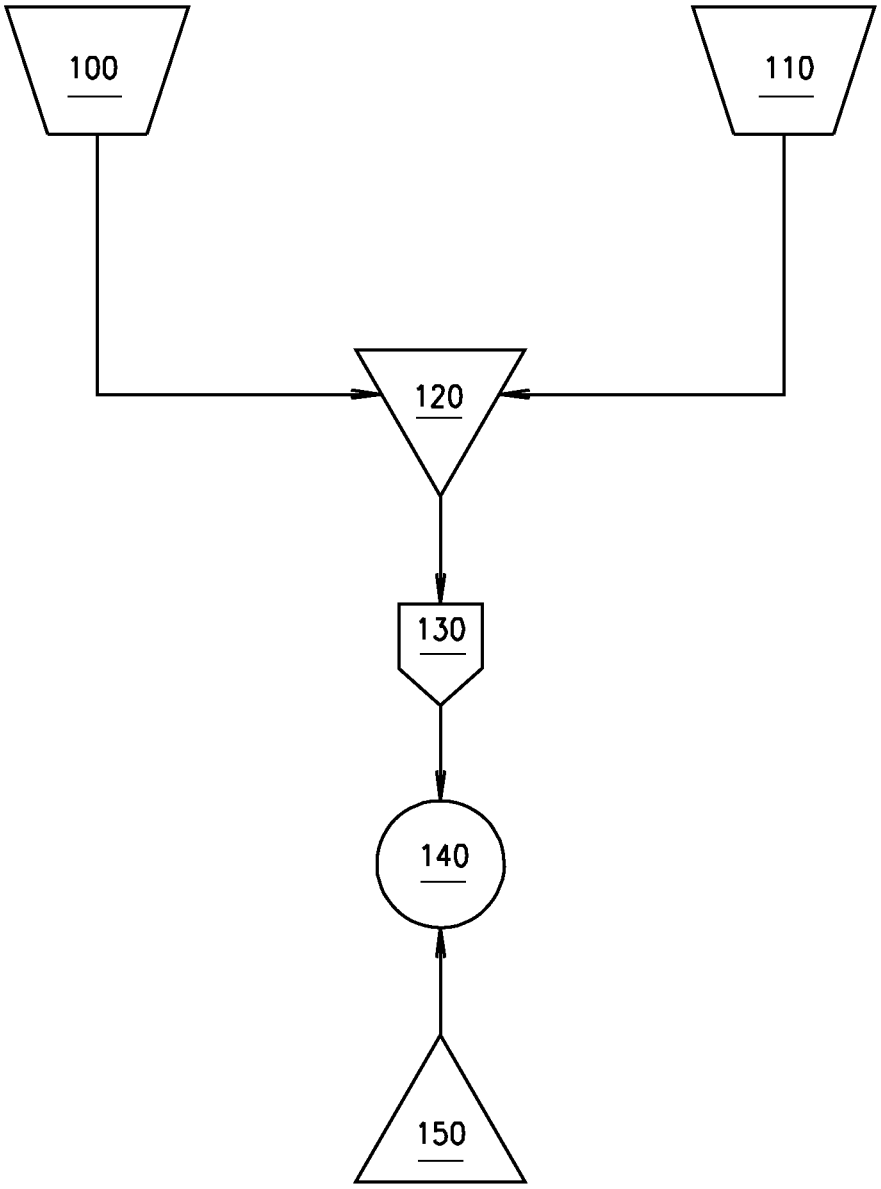

And, FIG. 16 shows a method of the invention that utilizes the previously described gage. An owner, lessee, or operator of a facility seeks to use the sink drains as an advertising platform. The facility owner, lessee, or operator then commissions installation of advertising, such as the rings 10 previously described and with suitable printing thereon. A user places a ring 10 upon the wall 25 of a gage 20, as in step 100. Alternatively, the user places the tip 22 with its nose 26 into a hole in a planar ad of similar shape and hole pattern as a drain D, as in step 110. With an ad 10 upon the gage 20, the user removes any release layer from the ad and then inserts the tip 22 into a hole of a drain as in step 120. As in step 130, the user then positions the ad 10 at an appropriate location. A user may orient the printing or other indicia upon the ad for readability, such as the printing being readable when a user faces a faucet. A user may also orient the indicia or printing upon the ad using markings preprinted upon the ad 10. Such markings generally guide the user to position the ad towards a faucet. With the ad 10 in position, the user presses upon the ad 10 or otherwise causes the ad to engage the drain's surface, as in step 140. Following securement of the ad 10 upon the drain D, the user removes to gage 20 from the drain, as in step 150. The user then proceeds to the next drain in the facility.

From the aforementioned description, a device and method for advertisements upon a ring has been described. The device and method for advertisements upon a ring are uniquely capable of positioning then securing a planar ring, or annulus, to a drain in a sink. Further, the device and method for advertisements upon a ring may also secure to a flat drain with or without a pattern of holes therein. The device and method for advertisements upon a ring and its various components may be manufactured from many materials, including but not limited to, paper, vinyl, polymers, such as nylon, polypropylene, polyvinyl chloride, high density polyethylene, polypropylene, ferrous and non-ferrous metal foils, their alloys, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A device for placing a planar material centered and proximate a drain, said device comprising:

a gage;

said gage having a body, a top surface and an opposite bottom surface, said top surface and said bottom surface being mutually parallel and spaced apart, a wall extending from said top surface to said bottom surface, said wall providing a centering mechanism adapted to place the planar material concentric with the drain, and a tip centered upon said bottom surface and extending outwardly from said bottom surface, said tip being slender, elongated, and having a round cross section and a truncated conical nose opposite said top surface;

wherein a user places said tip into the centermost hole of a drain, said bottom surface abuts said drain, and said top surface positions outwardly from said drain.

2. The planar material placing device of claim 1 further comprising:

said top surface and said bottom surface being round and said top surface and said bottom surface having the same diameter, said wall being perpendicular to said top surface and to said bottom surface, said wall being parallel to said tip.

3. The planar material placing device of claim 2 further comprising:

said body being a disc.

4. The planar material placing device of claim 1 further comprising:

said top surface and said bottom surface being round, said top surface having a lesser diameter than said bottom surface, and said wall having a beveled and inward orientation towards said top surface.

5. The planar material placing device of claim 4 wherein said nose is rounded over, said nose being opposite said bottom surface.

6. The planar material placing device of claim 4 wherein said nose has a hemispherical shape and a diameter less than the distance between said top surface and said bottom surface.

7. A centering device for a planar material applied proximate a drain in sink by a user, said device comprising:

a gage having a round body, a round top surface and an opposite round bottom surface mutually parallel and spaced apart and defining a thickness between them, a wall extending from said top surface to said bottom surface and having a height of the thickness, said wall providing a centering mechanism adapted to place the planar material concentric with the drain, and a slender, elongated tip centered upon said bottom surface and extending normally from said bottom surface for a length exceeding the thickness, and said tip having a round cross section and a truncated conical nose opposite said top surface;

an integral cylindrical handle centered upon said top surface opposite said tip, said handle being of lesser diameter than said top surface and coaxial with said tip, and said handle adapted to allow a user to grip said device solely by contacting said handle;

wherein a user places said tip into the centermost hole of a drain, said bottom surface abuts said drain, and said top surface positions outwardly from said drain.

8. The centering device of claim 7 further comprising:

said top surface and said bottom surface having the same diameter, said wall being perpendicular to said top surface and to said bottom surface, said wall being parallel to said tip.

9. The planar material placing device of claim 7 further comprising:

said top surface and said bottom surface being round, said top surface having a lesser diameter than said bottom surface, and said wall having an inward bevel;

said body being of a truncated conical shape.

10. A method for placing a planar material proximate a drain beneath a faucet, the method comprising:

inserting a gage into a drain, said gage having a round body, a round top surface and an opposite round bottom surface mutually parallel and spaced apart and defining a thickness between them, a wall extending from said top surface to said bottom surface and having a height of the thickness, and a slender, elongated tip centered upon said bottom surface and extending normally from said bottom surface for a length exceeding the thickness, said tip having a truncated conical nose opposite said top surface, and an integral cylindrical handle centered upon said top surface opposite said tip, said handle being of lesser diameter than said top surface, coaxial with said tip, and having a length greater than the height of said wall;

placing said planar material around said gage;

moving said planar material along said gage;

securing said planar material upon the drain; and, removing said gage from the drain.

11. The planar material placing method of claim 10 further comprising:

said inserting a gage including placing said nose into the drain wherein said gage abuts the drain and said tip enters the drain;

said securing said planar material including centering said planar material upon the drain; and, said removing said gage including separating said gage from said planar material.

* * * * *